US010270153B2

(12) United States Patent
Park et al.

(10) Patent No.: US 10,270,153 B2
(45) Date of Patent: Apr. 23, 2019

(54) SHARK FIN ANTENNA COMPRISING VEHICLE-TYPE V2X COMMUNICATION SYSTEM

(71) Applicant: LG INNOTEK CO., LTD., Seoul (KR)

(72) Inventors: Young Hun Park, Seoul (KR); Dong Woo Kim, Seoul (KR); Sae Hyun Lee, Seoul (KR); Hyun Woo Lim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/556,428

(22) PCT Filed: Dec. 7, 2015

(86) PCT No.: PCT/KR2015/013305
§ 371 (c)(1),
(2) Date: Sep. 7, 2017

(87) PCT Pub. No.: WO2016/143984
PCT Pub. Date: Sep. 15, 2016

(65) Prior Publication Data

US 2018/0108972 A1 Apr. 19, 2018

(30) Foreign Application Priority Data

Mar. 9, 2015 (KR) ..... 10-2015-0032573

(51) Int. Cl.
*H01Q 1/12* (2006.01)
*H01Q 1/32* (2006.01)
(Continued)

(52) U.S. Cl.
CPC ..... *H01Q 1/1214* (2013.01); *G08G 1/161* (2013.01); *H01Q 1/3275* (2013.01); *H01Q 1/52* (2013.01);
(Continued)

(58) Field of Classification Search
CPC .... H01Q 1/1214; H01Q 1/247; H01Q 1/3275; H01Q 1/52; H01Q 5/30; H01Q 1/42
See application file for complete search history.

(56) References Cited

U.S. PATENT DOCUMENTS 8,836,604 B2 * 9/2014 Yang ..... H01Q 1/3275 343/872
2012/0239294 A1 9/2012 Staehlin et al.
(Continued)

FOREIGN PATENT DOCUMENTS

KR 10-1129096 B 3/2012
KR 10-2013-0066485 A 6/2013
(Continued)

OTHER PUBLICATIONS

Search Report, dated Mar. 30, 2016, for International Application No. PCT/KR2015/013305.
(Continued)

*Primary Examiner* — Hoang V Nguyen
(74) *Attorney, Agent, or Firm* — LRK Patent Law Firm

(57) ABSTRACT

A shark fin antenna equipped with a V2X communication system which ensures high-efficiency performance in a moving vehicle, thereby wirelessly providing various frequency transmitting/receiving signals to a user's vehicle, an adjacent vehicle as desired by the user, and a pedestrian, whereby an integrated telematics service including a safety based service is provided. The shark fin antenna includes a fixing part arranged on which an antenna is installed within an applicable range of its internal space, produces an antenna similar to the form of the fixing part, thereby implementing a small-sized antenna and smoothly receiving signals of various bands due to favorable antenna gain and radiation pattern condition, and combines the antenna gain and radiation pattern condition while providing the forms of an antenna unit and an auxiliary unit, thereby flexibly responding to receiving signals of different bands according to use regions.

17 Claims, 11 Drawing Sheets

(51) Int. Cl.

| | |
|---|---|
| ***H01Q 5/30*** | (2015.01) |
| ***G08G 1/16*** | (2006.01) |
| ***H01Q 1/52*** | (2006.01) |
| *H01Q 1/24* | (2006.01) |
| *H01Q 1/42* | (2006.01) |

(52) U.S. Cl.
CPC ..... *H01Q 5/30* (2015.01); *H01Q 1/247* (2013.01); *H01Q 1/42* (2013.01)

(56) References Cited

U.S. PATENT DOCUMENTS

| | | | | |
|---|---|---|---|---|
| 2013/0342405 | A1* | 12/2013 | Ueno | H01Q 1/3275 343/713 |
| 2015/0097738 | A1* | 4/2015 | Sugimoto | H01Q 1/3275 343/702 |

FOREIGN PATENT DOCUMENTS

| | | | |
|---|---|---|---|
| KR | 10-2014-0136191 | A | 11/2014 |
| KR | 10-2014-0136682 | A | 12/2014 |
| KR | 10-2015-0009395 | A | 1/2015 |
| KR | 10-2015-0022795 | A | 3/2015 |
| KR | 10-2015-0056711 | A | 5/2015 |
| KR | 10-2015-0135160 | A | 12/2015 |
| WO | 2013/090783 | A1 | 6/2013 |

OTHER PUBLICATIONS

Written Opinion, dated Mar. 30, 2016, for International Application No. PCT/KR2015/013305.

European search report for European Patent Application No. 15884783.0 dated Feb. 1, 2018 corresponding to the above-referenced U.S. application.

* cited by examiner

SHARK FIN ANTENNA COMPRISING VEHICLE-TYPE V2X COMMUNICATION SYSTEM

CROSS-REFERENCE TO RELATED APPLICATION(S)

The present application is a U.S. National Phase entry from International Application No. PCT/KR2015/013305, filed Dec. 7, 2015, which claims priority to Korean Patent Application No. 10-2015-0032573, filed Mar. 9, 2015, the disclosure of which is incorporated by reference herein in its entirety.

BACKGROUND OF THE INVENTION

1. Field of the Invention

The present invention relates to a shark fin antenna equipped with the vehicle to everything (V2X) of a communication system for a vehicle and, more particularly, to an integrated telematics antenna mounted on a vehicle and a V2X communication system structure using the same.

2. Description of Related Art

Recently, there is a growing interest in the smart car as a representative convergence industry using the information communication technology. An object of such a smart car is to provide a driver or fellow passenger with entertainment experiences by enabling various Apps for a vehicle to be used through the grafting of the information communication technology or to improve economic feasibility and efficiency by providing a driving pattern of a driver or real-time traffic information. Furthermore, one of several objects of the smart car is to fundamentally prevent an accident or minimize a loss of lives when an accident occur.

Today, V2X communication has been in the spotlight as a method to which the information communication technology is applied. V2X (Vehicle-to-Infra, Vehicle, Nomadic, etc.) refers to all types of communication methods which may be applied to a vehicle, and means a detailed communication technology for implementing a "Connected Vehicle" or a "Networked Vehicle." In this case, V2X networking is basically divided into three categories, that is, vehicle-to-infrastructure (hereinafter V2I) communication, vehicle-to-vehicle (hereinafter V2V) communication and vehicle-to-nomadic devices (hereinafter V2N) communication, and receives wireless data from antennas mounted on the inside/outside of a vehicle and provides a driver-focused service using the wireless data. AM/FM radio, XM satellite radio, GPS, DMB, etc. are representative as the V2X networking. A system providing various services using the V2X networking is disposed within a vehicle.

An AM/FM antenna, XM the antenna, GPS and DMB antenna for transmitting and receiving V2X communication data are connected to a V2X communication unit through an RF cable, and are located inside or outside a vehicle. The length of the RF cable that connects V2X communication is determined by the location where each antenna is mounted.

For this, a configuration and operating method for a shark fin antenna for a vehicle are used in a conventional technology. In the conventional technology, GPS, CDMA, DMB and AM/FM band signals are received through the antennas within the shark fin antenna, and the received signals are transferred to the RF cable connected to a receiver.

However, in a vehicle communication system that gradually becomes diversified, the use of the RF cable for a connection between the antennas and the V2X communication system becomes the cause of errors, such as a loss according to the length, RF signal attenuation attributable to external radio noise, and radio interference signals within the vehicle.

SUMMARY OF THE INVENTION

The present invention has been made to solve the above problems and an object of the present invention is to obviate an RF cable for a connection between antennas and a communication module because a V2X communication module and a satellite integration antenna are embedded in a shark fin antenna and to reduce the total size of a shark fin antenna by adjusting the height of a DMB antenna and AM/FM antenna included in the shark fin antenna.

Furthermore, an object of the present invention is to provide wireless services inside and outside a vehicle, such as various leisure services, driving patterns and real-time traffic information, and to prevent an accident by providing safety-related information to a driver and a pedestrian through a V2X system for a vehicle using an antenna.

A shark fin antenna equipped with a vehicle type V2X communication system for solving the objects includes a circuit board, a V2X communication unit mounted on one surface of the circuit board, a satellite integration system unit mounted on the same surface of the circuit board on which the V2X communication unit is mounted and disposed to neighbor the V2X communication unit, a fixing part covering the circuit board, the V2X communication unit and the satellite integration system unit and having some region opened, and an antenna part coupled to the top of the fixing part.

The satellite integration system unit includes at least one antenna of GPS, Glonass and Galileo and further includes an XM/SIRIUS antenna. The satellite integration system unit includes a low-noise amplifier (LNA) and is connected to a plurality of antennas within the satellite integration system unit.

The fixing part is divided into an upper fixing part, a middle fixing part and a lower fixing part. The upper fixing part is configured to surround the sides of the satellite integration system unit and to externally expose the top of the satellite integration system unit. The middle fixing part includes a first middle fixing part, a second middle fixing part, a third middle fixing part connected to part of the first middle fixing part and part of the second middle fixing part, and a non-connection part. The lower fixing part is configured to surround an area in which an AM/FM magnetic body is accommodated and to externally expose the AM/FM magnetic body.

The antenna part includes at least any one of a 3G/4G antenna, a V2X passive antenna, an AM/FM antenna and a DMB antenna.

The V2X communication unit is located in the center of the circuit board. The V2X passive antenna is coupled to the tops of the first middle fixing part and the second middle fixing part and is connected to the V2X communication unit by a cable of 1-10 cm in length. The AM/FM antenna is coupled to the top of the third middle fixing part and an AM/FM magnetic body. The end of the AM/FM antenna is bent in the non-connection part. The DMB antenna is coupled to the top of the lower fixing part.

Advantageous Effects

In accordance with the present invention, the shark fin antenna equipped with the V2X communication system does not require an RF cable for a connection between an antenna and a communication module because the V2X the communication module and the satellite integration antenna are embedded and can reduce the total size of the shark fin antenna by adjusting the height of the DMB antenna and AM/FM antenna included in the shark fin antenna.

Furthermore, V2X services (vehicle services, including leisure service, driving patterns, real-time traffic information and safety-related information) can be provided a vehicle and a pedestrian which transmit and receive signals because various frequency transmission/reception signals can be provided to a pedestrian in addition to the vehicle of a user and an adjacent vehicle using the V2X system for a vehicle, including vehicle-to-infrastructure (hereinafter V2I) communication, vehicle-to-vehicle (hereinafter V2V) communication and vehicle-to-nomadic devices (hereinafter V2N) communication, and an antenna connected to the V2X system.

DETAILED DESCRIPTION OF THE INVENTION

Figure 1:
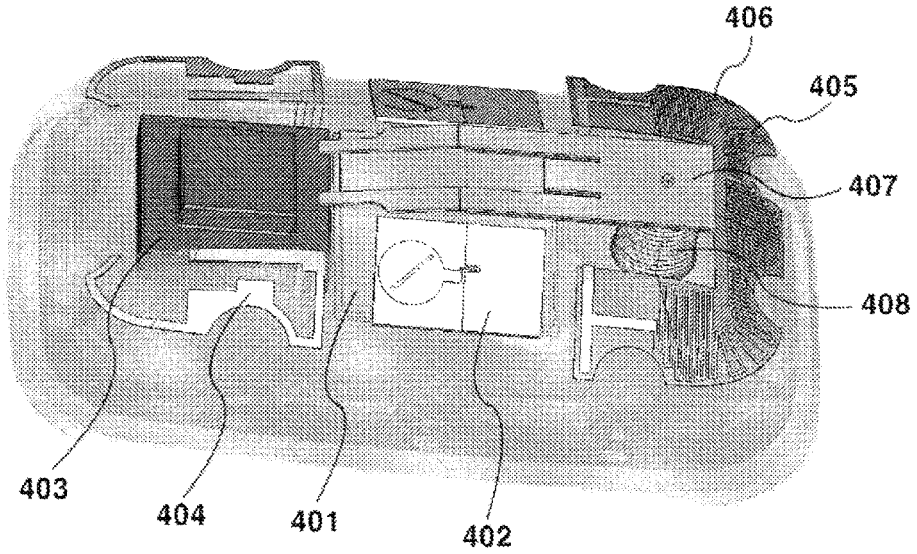
FIG. 1 is a diagram showing antennas mounted on an apparatus shape according to an embodiment of the present invention.

Hereinafter, a construction and operation according to the preferred embodiments of the invention are described in detail with reference to the accompanying.

A shark fin antenna for a vehicle according to an embodiment of the present invention may include a support 100, a circuit board 200, a fixing part 300, an antenna part 400 and a casing 500.

Figure 2:
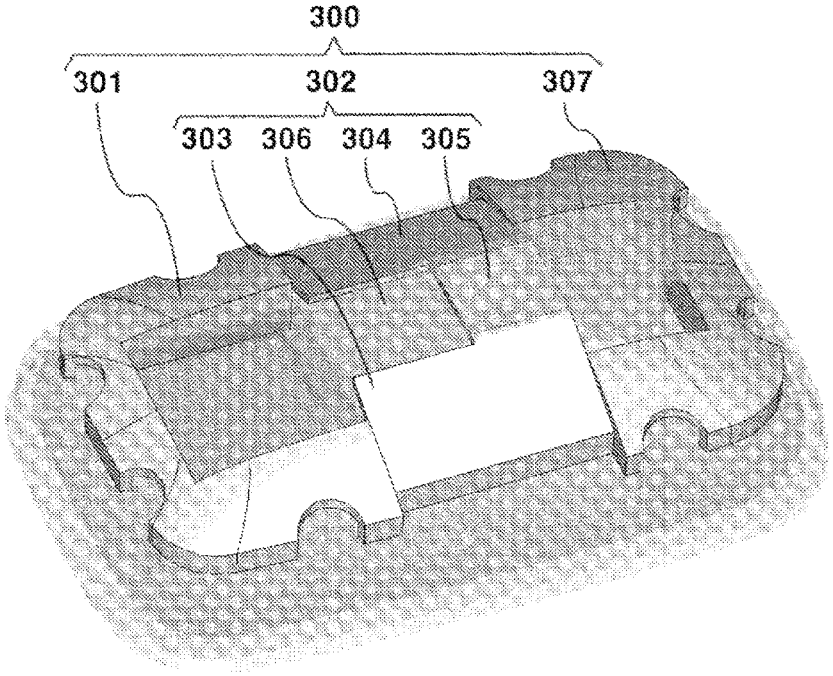
FIG. 2 is a diagram showing the shape of a fixing part for fixing the antennas according to an embodiment of the present invention.
Figure 3:
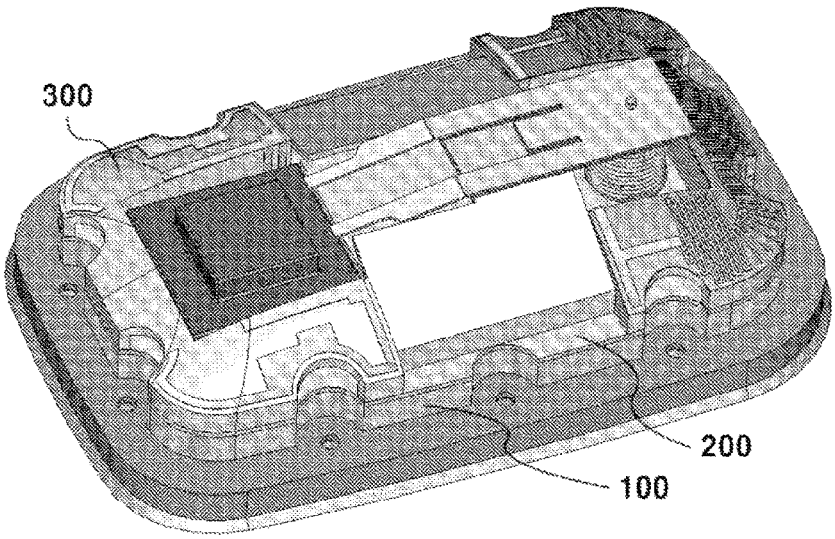
FIG. 3 is a diagram showing that the antennas of FIG. 1 according to an embodiment of the present invention have been coupled to the fixing part of FIG. 2.
Figure 4:
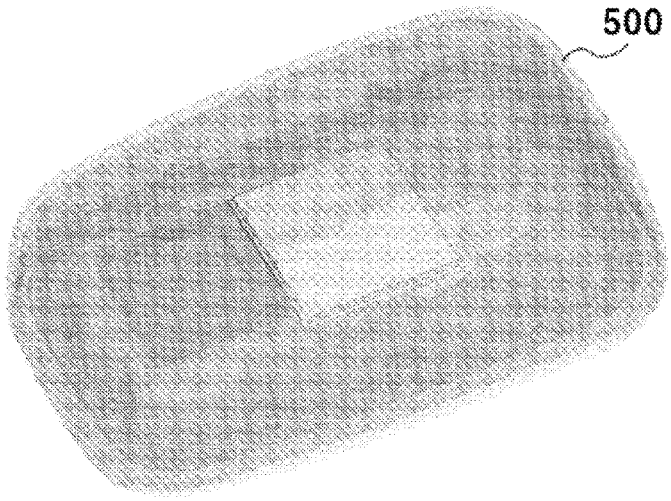
FIG. 4 is a diagram showing a shark fin antenna on which a casing according to an embodiment of the present invention has been mounted.
Figure 5:
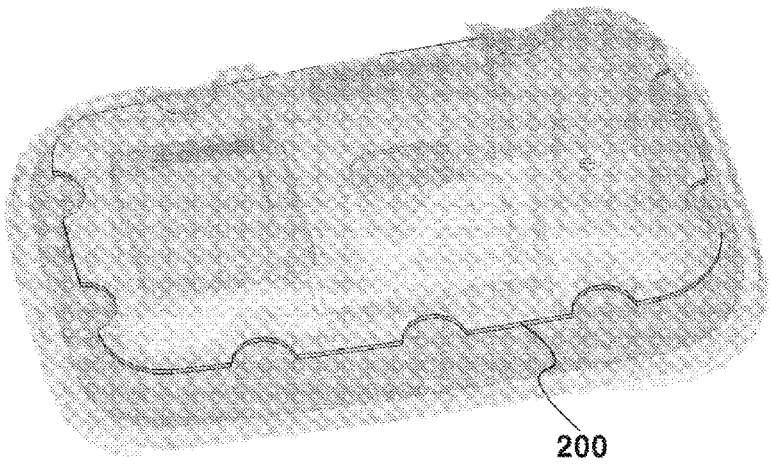
FIG. 5 is a diagram showing a circuit board according to an embodiment of the present invention.

FIG. 1 is a diagram showing that several parts have been located within the shark fin antenna for a vehicle according to an embodiment of the present invention. FIG. 2 is a diagram showing the fixing part for locating several parts within the shark fin antenna for a vehicle according to an embodiment of the present invention. FIG. 3 shows a diagram in which the parts have been seated in the fixing part. FIG. 4 is a diagram showing that the casing has been coupled to the shark fin antenna. FIG. 5 is a diagram showing the circuit board.

The support is located at the bottom of the shark fin antenna. The circuit board, the fixing post and a variety of types of antennas are disposed on one surface of the support. The casing are coupled over the circuit board, the fixing post and a variety of types of antennas to form a close type shark fin antenna structure. The coupling of the support and the casing may be performed using various methods. For example, the support and the casing may be may be coupled using a bolt and a nut.

As shown in FIG. 5, the circuit board is coupled to one surface of the support. The variety of types of antenna parts, the fixing part capable of fixing the antenna parts, a screw groove part coupled to the casing, and circuit wiring to which the antenna parts are connected have been formed on one surface of the circuit board. As shown in FIG. 1, various services can be provided using an AM/FM signal, a T-DMB signal, satellite integration (GPS, Glonass, Galileo, XM and SIRIUS), a wave signal, a Wi-Fi signal and 3G/4G signals depending on the type of antenna.

The fixing part has a form that covers the top of the circuit board as shown in FIG. 2 and enables the antennas to be disposed at specific locations, thereby being capable of retaining the characteristics of the antennas disposed therein and improving efficiency. The fixing part is divided into the top, middle and bottom. Different antennas are coupled at the respective locations of the fixing part in accordance with their shapes. Furthermore, the locations of the fixing part in which the top, middle and bottom are divided and shapes thereof are determined by the screw groove part coupled to the casing and the shapes of the antennas disposed in the fixing part.

The upper fixing part is configured to be located in the front part of the fixing part and to surround the side of a satellite integration system unit located in the center of the upper fixing part and to expose the top of the satellite integration system unit to the outside. Furthermore, 3G/4G antennas are respectively coupled to both sides of the top of the remaining upper fixing part other than a portion through which the top of the satellite integration system unit is externally exposed and the screw groove part coupled to the casing.

The middle fixing part is located in the middle of the fixing part and covers a V2X communication unit located at the center of the circuit board. V2X antennas for communicating with the V2X communication unit are respectively coupled to a first middle fixing part and a second middle fixing part, that is, both sides of the top of the middle fixing part. The central part of an AM/FM antenna of a pole sheet form having a long length is coupled to a third middle fixing part connected between the first middle fixing part and the second middle fixing part. Since the end part of the AM/FM antenna is slightly downward bent, the remaining portion other than the third middle fixing part is designated as a non-connection part in which the space has been formed and may be located in the end part of the AM/FM antenna.

The lower fixing part is configured to be located in the rear of the fixing part and to surround the sides of an AM/FM magnetic body located in the middle of the lower fixing part and to externally expose a portion where the AM/FM magnetic body and the AM/FM antenna are coupled. Furthermore, a DMB magnetic body and a DMB antenna are coupled to the top of the remaining lower fixing part other than the portion where the AM/FM magnetic body and the AM/FM antenna are coupled and the screw groove part coupled to the casing.

The antenna part is located within the shark fin antenna so that radiation characteristics and efficiency of the antennas can be maximized, and may transmit and receive a variety of types of signals and provide various services to a driver using the signals. The antenna part is equipped with the AM/FM antenna, the T-DMB antenna, the 3G/4G antennas, the V2X (DSRC) passive antenna, etc. As shown in FIG. 3, the locations of the antenna part are distributed in accordance with the characteristics of the respective antennas. The antenna part is fabricated in a form in which all of the antennas are exposed to the top of the fixing part in which the antennas are disposed for the smooth data transmission and reception of the antennas or fabricated in a form in which an accommodation space is disposed in the fixing part and the top of the antenna part is exposed. The V2X communication unit receives wireless data from all of the antennas disposed in the shark fin antenna and provides a driver-focused service to a driver using a device, such as a USB terminal, an Ethernet cable or Bluetooth.

The antenna part may include a plurality of antennas having different characteristics within the casing. Signal interference may be generated between the antennas. If isolation between the antennas is secured using a filter, several antennas may be located in the same space because mutual interference between different radio waves is minimized. The antennas may be considered to be not influenced each other if they have isolation of −30 dB. If isolation of −30 dB or more is secured, a signal interference phenomenon between a plurality of antennas can be minimized although the plurality of antennas having different characteristics is disposed within the casing. Accordingly, each antenna can maintain its unique characteristic without any change.

As shown in FIG. 4, the casing has a dome shape whose bottom is open and whose inside is empty. The casing has a shark fin form. Accordingly, not only the design when the casing is coupled to a vehicle and air resistance generated when the vehicle is driven are taken into consideration in the casing, but the casing provides a luxurious design because it is located on top of the vehicle and also has a height of a specific length or more for accommodating elements, such as the fixing part and the antenna part, within the shark fin antenna.

Figure 6:
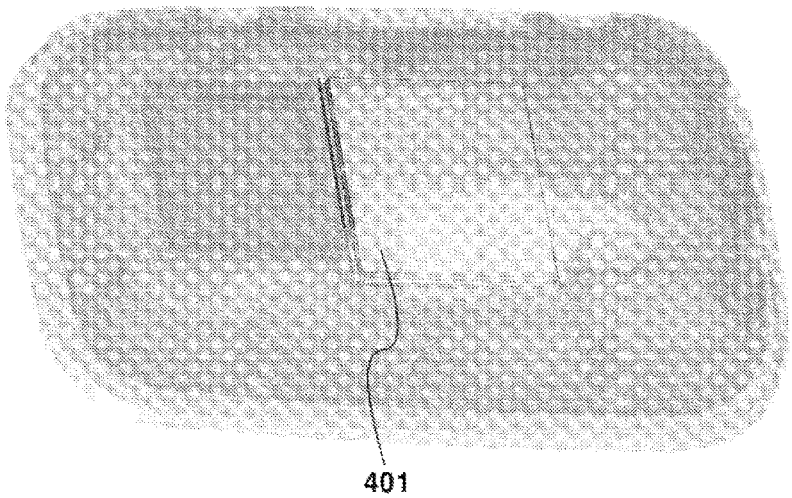
FIG. 6 is a diagram showing a V2X communication unit mounted on the circuit board according to an embodiment of the present invention.
Figure 7:
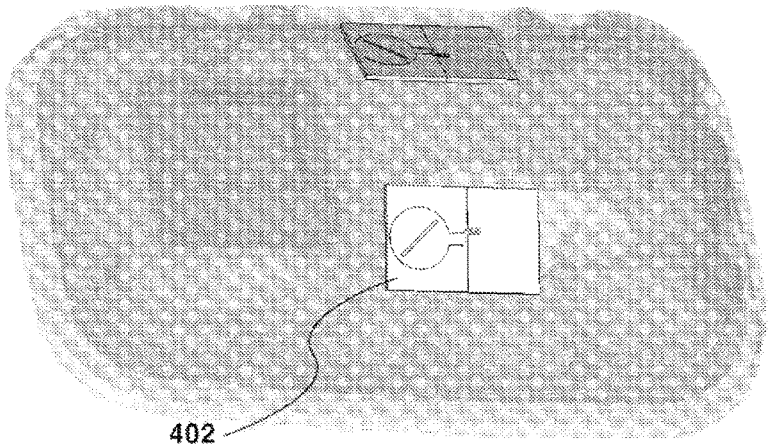
FIG. 7 is a diagram showing a V2X (DSRC) passive antenna according to an embodiment of the present invention.

FIG. 6 is a diagram showing the V2X communication unit mounted on the circuit board according to an embodiment of the present invention. FIG. 7 is a diagram showing the V2X (DSRC) passive antenna according to an embodiment of the present invention.

The V2X communication unit of FIG. 6 receives all of pieces of antenna information within the shark fin antenna and is located at the center of the circuit board for this, thereby being capable of minimizing the wiring of the V2X communication unit and the antennas. For example, the V2X antennas of FIG. 7 are located on both sides of the top of the middle fixing part which is closest to the V2X communication unit, and are connected to the V2X communication unit by a cable of several centimeters.

The V2X system using the V2X communication unit can provide vehicle-automatic control and safety driving to a driver using information about a surrounding vehicle, a road environment, etc. which are obtained while a user vehicle is driven, and can share the information with a surrounding vehicle by checking information about the state (speed, acceleration, brake operation information and GPS coordinates) of the user vehicle in real time in order to secure stability between vehicles. Accordingly, the user vehicle can obtain accident danger information about a surrounding vehicle, and thus the driver can prevent a safety accident through active handling.

A service based on the location of the V2X system using the V2X communication unit and a vehicle safety-related service using the service are described in detail. A vehicle accident danger state is determined when a change in a surrounding vehicle is a threshold or more because the speed and acceleration of the surrounding vehicle are reduced and a change in the surrounding vehicle is a preset threshold or more right before an accident occurs. Furthermore, a brake operation is suddenly performed and a brake operation signal is increased. In this case, the vehicle accident danger state is determined when the change is the preset threshold or more. When a change in the operation of the speed, acceleration or brake of the threshold or more is detected in the user vehicle and/or the surrounding vehicle, it is determined that a vehicle accident will occur. After the accident is generated, the airbag of the surrounding vehicle is actuated, an airbag operation signal is generated at the same time, and a change in the brake capable of prohibiting the speed and acceleration maintains a high value (a value of the threshold or more). Furthermore, if the accident occurs, there is a possibility that a great accident may occur depending on the surrounding vehicle (specifically, the surrounding vehicle means the front, rear and sides of a vehicle adjacent to the user vehicle). Accordingly, the V2X communication unit checks that the surrounding vehicle is located in which direction and distance of the user vehicle. The satellite integration system unit transfers information about the location of the user vehicle to the V2X communication unit. The V2X communication unit has to be capable of determining whether or not to transmit accident danger information in advance by taking into consideration the information about the location of the user vehicle and information about the location of the surrounding vehicle.

Figure 8:
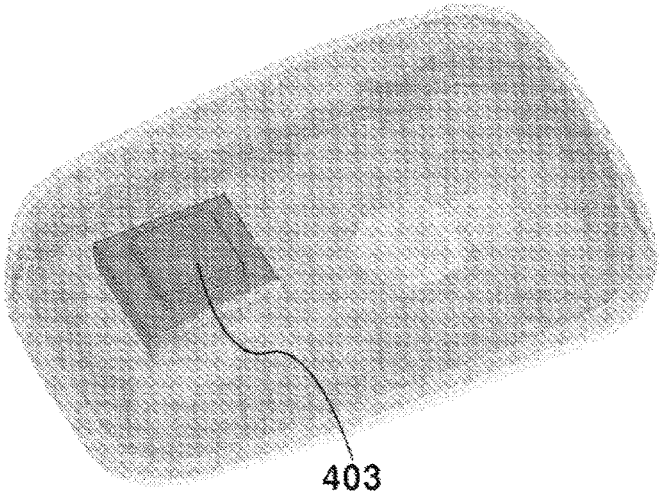
FIG. 8 is a diagram showing a satellite integration system unit according to an embodiment of the present invention.

FIG. 8 is a diagram showing the satellite integration system unit according to an embodiment of the present invention.

The satellite integration system unit of FIG. 8 may be fabricated in such a manner that it includes a satellite integration antenna and the top of the satellite integration system unit including the antenna is open in order to reduce a loss of data. For example, if a different metal material is present on the satellite integration antenna, the satellite integration antenna may be influenced by interference attributable to the metal. Accordingly, the upper fixing part is fabricated in a form that surrounds the sides of the satellite integration system unit to form the accommodation space and to open the top of the satellite integration system unit, thereby being capable of reducing interference attributable to the upper fixing part.

The satellite integration antenna connected to the V2X system includes antennas capable of being supplied with the satellite frequencies of GPS (U.S.A.), Glonass (Russia) and Galileo (Europe). Accordingly, the satellite integration antenna can be used anywhere in the world, can be provided with a more precise location service, and can provide safety-related services, such as the location and speed driving information of the vehicle, to the inside/outside of the vehicle. Furthermore, the total size of the satellite integration system can be reduced because the satellite radio system XM/SIRIUS antennas are integrally designed and GPS, Glonass, Galileo and a low-noise amplifier (LNA) are used in common.

Figure 9:
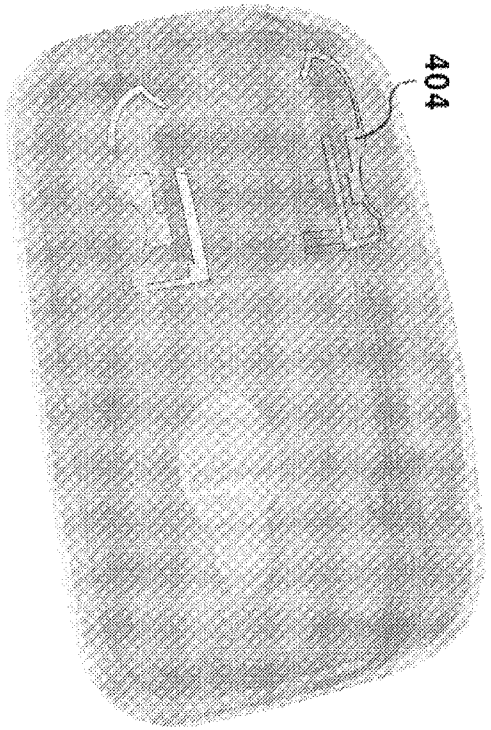
FIG. 9 is a diagram showing 3G/4G antennas according to an embodiment of the present invention.

FIG. 9 is a diagram showing the 3G/4G antennas according to an embodiment of the present invention.

The 3G/4G antennas of FIG. 9 are responsible for receiving 3G/4G signals of the signals of the antennas for a vehicle. The 3G/4G antennas are located on both sides of the top of the upper fixing part to provide an excellent environment in 3G/4G communication within the vehicle. The 3G/4G antennas have a different frequency range and reception ratio depending on the length and shape of the antennas. Accordingly, the length and shape of the 3G/4G antennas may be changed depending on an impedance matching value so that the 3G/4G antennas can receive frequency bands of 3G/4G signals. In particular, the 3G/4G antennas can receive an ultrahigh frequency of a 1750 MHz~1870 MHz frequency band. Since the antennas for receiving the ultrahigh frequency can operate in a short length, they may be formed in a form similar to the shape of both sides of the top of the upper fixing part and may include a 3G/4G antenna connection part that stands upright on the circuit board.

Figure 10:
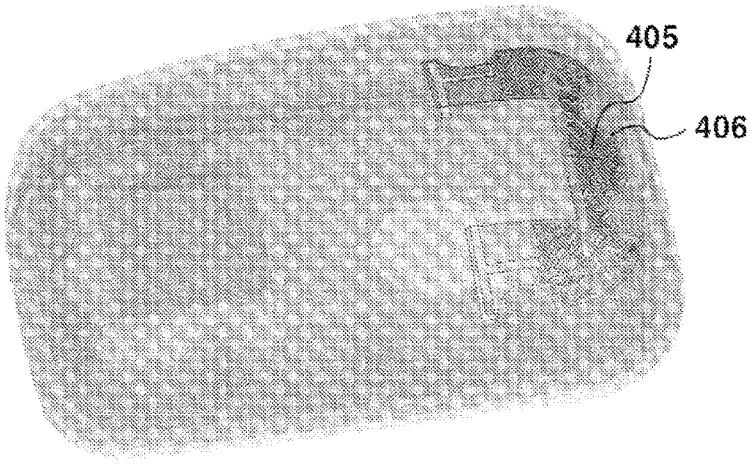
FIG. 10 is a diagram showing a DMB antenna and a magnetic body according to an embodiment of the present invention.

FIG. 10 is a diagram showing the DMB antenna and the magnetic body according to an embodiment of the present invention.

The DMB antenna of FIG. 10 is an element for receiving the signal of a digital multimedia broadcasting (DMB) band and provided in a sheet in which an antenna pattern has been formed on top of the lower fixing part. Accordingly, the DMB antenna may be formed in a shape similar that of the top of the lower fixing part. In this case, the DMB antenna may be provided to receive terrestrial digital multimedia broadcasting (TDMB) and HSDPA signals, digital audio broadcasting band III (DABIII) and DAB-L signals, and a GSM signal (GSM850/1900) depending on the area where the shark fin antenna according to the present invention is used.

That is, the DMB antenna according to the present invention may be divided into Korea use, North America use and Europe use. Accordingly, the DMB antenna must be fabricated so that it corresponds to a communication standard adopted in each country because a frequency band is different for each country depending on the aforementioned communication standard. The DMB antenna may be provided to receive terrestrial digital multimedia broadcasting (TDMB) and HSDPA signals for use in Korea, may be provided to receive a GMS signal, that is, a band for North America, and may be provided to receive digital audio broadcasting band III (DABIII) and DAB-L signals, that is, a band for Europe, but the present invention is not limited thereto. The DMB antenna may be provided in various forms capable of smoothly receiving the frequency of each country.

Meanwhile, a DMB magnetic body is applied to the top of the lower fixing part and the DMB antenna is printed on one side of the DMB magnetic body. Accordingly, the height of the DMB antenna can be reduced, interference attributable to electromagnetic waves generated by another antenna can be suppressed by differently applying a magnetic permeability value, a sudden change in the signal can be prevented by suppressing the EMI of a wire and unnecessary noise can be reduced, thereby being capable of providing a terrestrial wave service based on an improved image.

Figure 11:
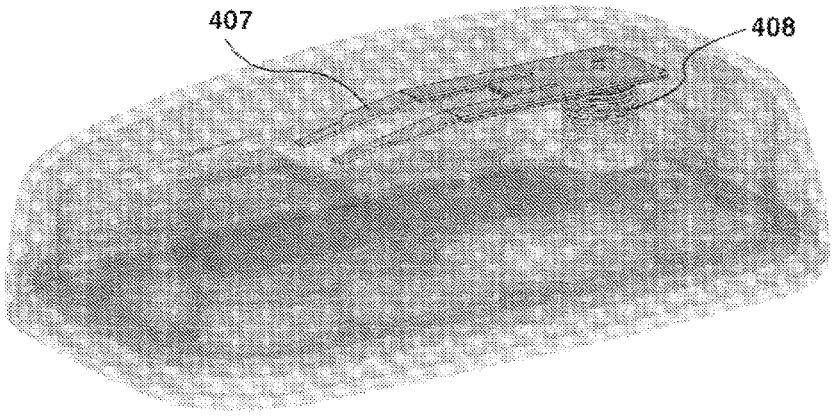
FIG. 11 is a diagram showing an AM/FM antenna and a magnetic body according to an embodiment of the present invention.

FIG. 11 is a diagram showing the AM/FM antenna and the magnetic body according to an embodiment of the present invention.

The AM/FM antenna of FIG. 11 can receive AM/FM signals in order to provide a voice-based terrestrial wave service while operating in conjunction with a radio system. The AM/FM antenna is a pole sheet form having a long length. The top of the AM/FM antenna is connected to the AM/FM magnetic body located in the middle of the lower fixing part. The middle of the AM/FM antenna is coupled to the third middle fixing part connected between the first middle fixing part and the second middle fixing part. The end of the AM/FM antenna is slightly downward bent. A portion except the first middle fixing part, the second middle fixing part and the third middle fixing part is designated as the non-connection part, and the space is formed in the non-connection part.

The AM/FM magnetic body is an element for suppressing the interference waves of the AM/FM antenna. If a variety of types of RF parts having different functions are disposed in the shark fin antenna or antennas operating in different bands are disposed in the shark fin antenna, the magnetic permeability value is differently applied to each of the parts. Accordingly, the transmission and reception of radio waves are smooth, the height of the antenna is reduced, and the EMI of a wire is suppressed.

As described above, the shark fin antenna equipped with the V2X communication system may have the following effects by guaranteeing high efficiency performance in a moving vehicle and wirelessly providing services regarding safety to the vehicle of a user and an adjacent vehicle and pedestrian wanted by the user through various frequency transmission/reception signals First, the shark fin antenna provides various frequencies of telematics because the V2X communication unit and the antennas are integrated.

Second, the shark fin antenna can reduce the use of communication cables by providing an optimized arrangement for the V2X communication unit and all of the disposed antennas.

Third, the shark fin antenna does not require a separate RF cable because it is directly connected to the satellite integration system unit.

Fourth, the shark fin antenna minimizes a loss of a radio signal because the V2X communication unit and the V2X antenna are connected by a cable of several centimeters in length.

Fifth, the shark fin antenna can be used anywhere in the world because it receives GPS/Glonass/Galileo satellite frequencies within the satellite integration system unit and can be provided with a more precise location service. Accordingly, the platform of a product using the shark fin antenna is made possible.

Sixth, the shark fin antenna can reduce the size of antennas because the satellite integration antenna within the satellite integration system unit and the XM/SIRIUS antenna share the LNA.

The shark fin antenna equipped with the vehicle-type V2X communication system is configured as an integration system having the V2X system embedded in the shark fin antenna and providing an integrated telematics service including a vehicle safety-based service.

Furthermore, the fixing part in which the antennas can be disposed is disposed in the space within the shark fin-type antenna according to the embodiment within an applicable range, and the antennas are fabricated in a form similar to that of the fixing part. Accordingly, the antennas can be implemented in a relatively small size in terms of the antenna and signals of various bands can be smoothly received because the gains of the antennas and a radiation pattern condition are excellent. The reception of a signal of a band different depending on a use area can be flexibly handled by variously providing the shapes of the antenna unit and an auxiliary unit in addition to various combinations of the elements. Furthermore, the mass production of products can be enhanced through a simple internal structure and a compact construction.

As described above, those skilled in the art to which the present invention pertains will appreciate that the present invention may be implemented in other detailed forms without changing the technological spirit or essential characteristics of the present invention. Accordingly, it is to be understood that the aforementioned embodiments are only illustrative and are not limitive. It is also to be noted that the illustrated flowchart is merely sequential order illustrated to achieve the most preferred results in implementing the present invention, and other additional steps may be provided or some of the steps may be deleted.

Furthermore, this specification is not intended to limit the present invention by the proposed detailed terms. Accordingly, although the present invention has been described in detail in connection with the aforementioned embodiments, a person having ordinary skill in the art to which the present invention pertains may alter, change, and modify the embodiments without departing from the technological spirit of the present invention.

| Description of reference numerals | |
|---|---|
| 100-support | 200-circuit board |
| 300-fixing part | 301-upper fixing part |
| 302-middle fixing part | 303-first middle fixing part |
| 304-second middle fixing part | 305-third middle fixing part |
| 306-non-connection part | 307-lower fixing part |
| 400-antenna part | 401-V2X communication unit |
| 402 - V2X (DSRC) passive antenna | 403-satellite integration system unit |
| 404 - 3G/4G antenna | 405-DMB antenna |
| 406-DMB magnetic body | 407-AM/FM antenna |
| 408-AM/FM magnetic body | 500-casing |

The invention claimed is:

1. A shark fin antenna equipped with a vehicle type V2X communication system, comprising:

a circuit board;

a V2X communication unit mounted on one surface of the circuit board;

a satellite integration system unit mounted on the one surface of the circuit board and disposed to be adjacent to the V2X communication unit;

a fixing part comprising an upper fixing part, a middle fixing part and a lower fixing part;

an antenna part coupled to a top of the fixing part, wherein the upper fixing part surrounds sides of the satellite integration system unit and externally exposes a top of the satellite integration system unit, wherein the middle fixing part covers the V2X communication unit, and wherein the lower fixing part surrounds an area in which an AM/FM magnetic body is accommodated and externally exposes the AM/FM magnetic body, where an AM/FM antenna is connected to the AM/FM magnetic body and where an end of the AM/FM antenna is bent in a non-connection part of the middle fixing part.

2. The shark fin antenna of claim 1, wherein the V2X communication unit is located at a center of the circuit board.

3. The shark fin antenna of claim 1, wherein the satellite integration system unit comprises at least one antenna of GPS, Glonass and Galileo.

4. The shark fin antenna of claim 3, wherein the satellite integration system unit further comprises an XM/SIRIUS antenna.

5. The shark fin antenna of claim 1, wherein the satellite integration system unit comprises a low-noise amplifier (LNA) and is connected to a plurality of antennas within the satellite integration system unit.

6. The shark fin antenna of claim 1, wherein the antenna part comprises at least one of a 3G/4G antenna, a V2X passive antenna, an AM/FM antenna and a DMB antenna.

7. The shark fin antenna of claim 6, wherein the 3G/4G antenna is coupled to a top of the upper fixing part.

8. The shark fin antenna of claim 6, wherein the middle fixing part comprises a first middle fixing part, a second middle fixing part, a third middle fixing part, and a non-connection part, wherein the third middle fixing part is connected to part of the first middle fixing part and part of the second middle fixing part.

9. The shark fin antenna of claim 8, wherein the V2X passive antenna is coupled to a top of both of the first middle fixing, part and the second middle fixing part.

10. The shark fin antenna of claim 8, wherein the AM/FM antenna is coupled to a top of the third middle fixing part and an AM/FM magnetic body.

11. The shark fin antenna of claim 6, wherein the V2X passive antenna is connected to the V2X communication unit by a cable of 1-10 cm in length.

12. The shark fin antenna of claim 6, wherein the DMB antenna is coupled to a top of the lower fixing part.

13. The shark fin antenna of claim 1, further comprising a support located at a bottom of the shark fin antenna and having the circuit board, the fixing part and, the antenna part disposed on one surface of the shark fin antenna.

14. The shark fin antenna of claim 13, further comprising a casing disposed over the support.

15. The shark fin antenna of claim 14, wherein the casing has a dome shape having a bottom open and an inside empty.

16. The shark fin antenna of claim 1, further comprising a DMB magnetic body coupled to a top of the lower fixing part.

17. The shark fin antenna of claim 1, wherein the V2X communication unit is located on both sides of a top of the middle fixing part.

* * * * *